United States Patent [19]

Steidinger

[11] Patent Number: 4,728,027

[45] Date of Patent: Mar. 1, 1988

[54] SHORT LENGTH MAILER STRUCTURE AND METHOD OF MANUFACTURE

[75] Inventor: Donald J. Steidinger, Barrington, Ill.

[73] Assignee: Wallace Computer Services, Inc., Hillside, Ill.

[21] Appl. No.: 875,549

[22] Filed: Jun. 18, 1986

[51] Int. Cl.[4] ..... B65D 27/10

[52] U.S. Cl. ..... 229/69

[58] Field of Search ..... 229/69; 282/11.5 R, 282/11.5 A

[56] References Cited

U.S. PATENT DOCUMENTS

| | | | |
|---|---|---|---|
| 3,104,799 | 9/1963 | Steidinger | 229/69 |
| 3,339,827 | 9/1967 | Steidinger | 229/69 |
| 3,905,545 | 9/1975 | Juszak et al. | 229/69 |
| 3,941,308 | 3/1976 | DiGirolomo et al. | 282/11.5 A |
| 4,108,352 | 8/1978 | Peschke | 229/69 |
| 4,342,472 | 8/1982 | Heimann et al. | 229/69 |
| 4,346,916 | 8/1982 | Shelton | 229/69 |
| 4,361,269 | 11/1982 | Neubauer | 229/69 |
| 4,492,334 | 1/1985 | Dicker | 229/69 |

FOREIGN PATENT DOCUMENTS

| | | | |
|---|---|---|---|
| 937905 | 12/1973 | Canada | 229/69 |

*Primary Examiner*—Stephen P. Garbe

*Attorney, Agent, or Firm*—Tilton, Fallon, Lungmus & Chestnut

[57] ABSTRACT

A series of stuffed sealed envelope assemblies wherein the interior plies are completely discontinuous once every fold length but in which a plurality of form lengths are provided within each fold length, the intermediate plies only being partially discontinuous each form length.

5 Claims, 1 Drawing Figure

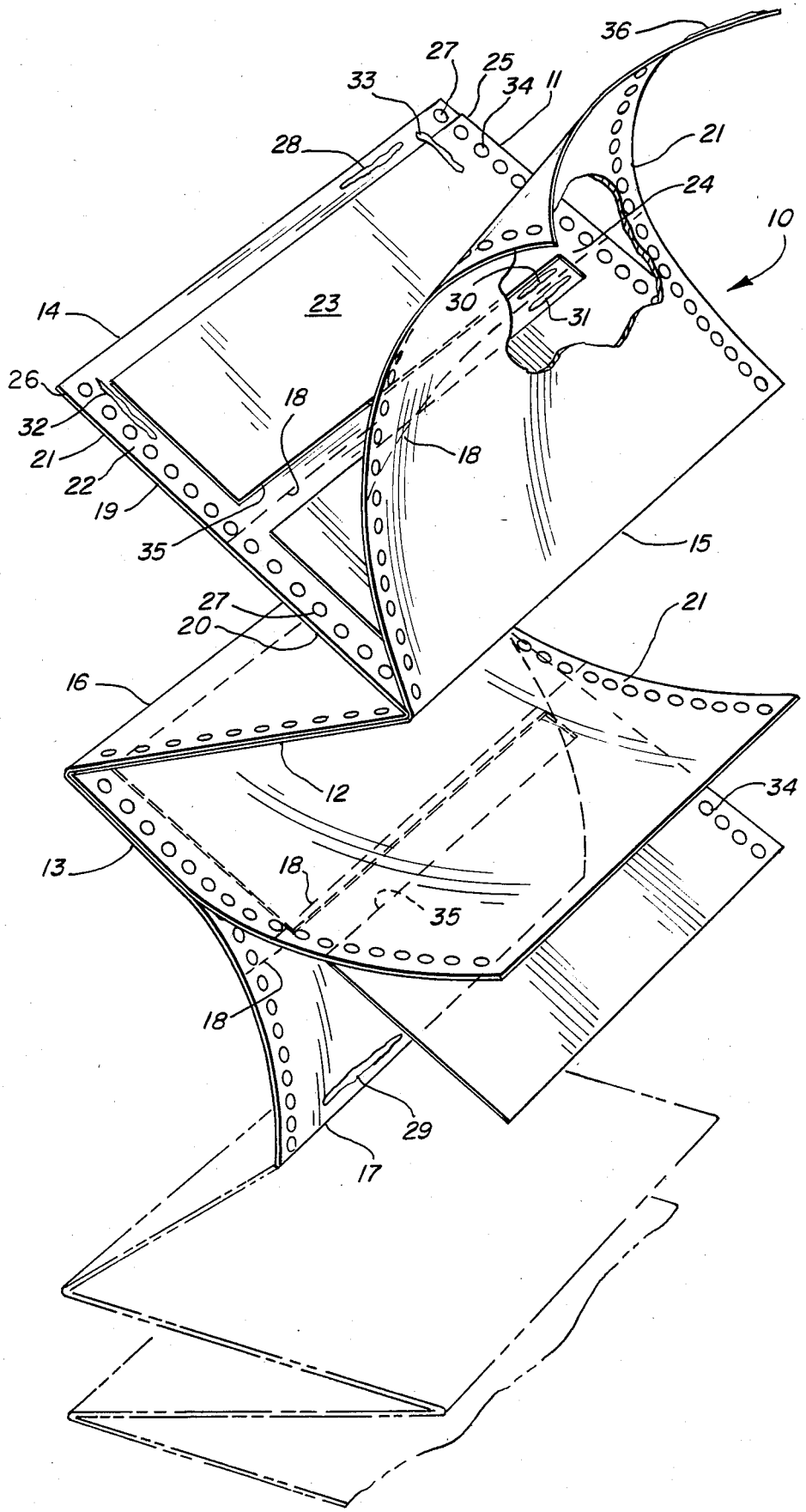
36
27
25
33
34
11
28
21
24
10
23
30
31
14
26
32
21
22
19
18
18
35
15
27
20
21
16
12
34
13
18
35
18
29
17

SHORT LENGTH MAILER STRUCTURE AND METHOD OF MANUFACTURE

This invention relates to a short length mailer structure and method of manufacture and, more particularly, to a business form suitable for mailer usage which eliminates disadvantageous tenting while maintaining precision of register of the interior plies.

BACKGROUND AND SUMMARY OF INVENTION

Since the introduction of mailer forms with U.S. Pat. No. 3,104,799, there have been a steady series of improvements. U.S. Pat. Nos. 3,339,827, 3,777,971 and 3,830,141 concerned increasing the freedom of the inside plies and means to control the position of the inside ply while inside the mailer to provide accurate registration of the computer printout.

U.S. Pat. No. 4,095,965 shows a mailer structure that best combines the various objectives in a mailer form, accurate position and control of the inside ply, minimum tenting, economical use of paper stock in manufacture and ease of opening the mailer and removal of the contents.

The difficulty of accomplishing these objectives in manufacturing is increased when length of the mailer is short. Mailers of 3½ to 4" in length are particularly difficult. The size of the die cutting elements in order to be rigid enough to perform a reliable function limits the minimum length of the cut piece that can be given control after it is cut off. It is understandable that the longer the time and distance that the cut insert is without positive control, the less accurate will be its position inside the mailer and less reliable the production process.

The improvement of this invention is to cut the inside plies free only once each fold length. Typically 3⅞ or 4" mailers are folded every 11 or 12" and 4¼" mailers every 8½".

Consider the 4¼" size for example. The inside ply is typically cut to 3½" long using a cutoff cylinder of 17 or 25½" circumference. It can be seen that mechanical elements, rollers and such that can be fit in close enough to the cutoff cylinders to engage the 3½" length before it is cut off and no longer controlled by the length of web feeding it into the cutting station would be so small as to lack the rigidity and strength necessary for reliable function in manufacture.

When these short lengths are handled in production according to this invention using the 4¼ length as an example, the inside plies would be cut from the infeeding web once every 8½" with the inside plies having a length of 7¾". This is more than twice the length of a single inside ply.

A die cut chip is still removed between the two 4¼" portions of the inside plies so each portion can retain its ease of removal from the mailer but a portion (or portions) join the two 3½" portions so that they can be handled for purposes of control in manufacturing as one piece. This method not only gives a much longer length with its easier control but also reduces the number of cut pieces by ½ (or ⅓) so there are fewer of these difficult pieces to be processed per 1000 forms lengths. This again improves manufacturing reliability.

By retaining the complete cutoff at each fold length, all of the tent reducing qualities of the mailer form are retained. The absence of a complete cutoff at the intermediate form length where the form is not to be folded does not increase tenting. Tenting is created only when the continuous form is folded causing some plies to fold along a longer path than others.

The invention is described in conjunction with the accompanying drawing in which a perspective view of a portion of a mailer assembly.

In the illustration given the numeral 10 designates generally an assembly of stuffed sealed envelopes and, for ease of presentation, only three fold lengths are presented. The fold lengths are designated 11, 12 and 13, respectively, and are defined by lines of potential folding as at 14, 15, 16 and 17. These are normally provided in the form of transverse lines of perforation extending across the webs constituting the stuffed sealed envelope assemblies. In normal practice, the webs are fan-folded, i.e., zig-zag or accordion folded so as to be packed in rectangular containers for shipment from the place of manufacture to the customer's place of use. Conventionally, the zig-zag folded forms are advanced through a computer printer for imprinting with addressee and other information such as billing, grades, etc.

In the illustration given, the fold length is 8½", viz., the distance between lines 14–15, 15–16, 16–17, etc. Intermediate the fold lines are provided lines of weakening as at 18 relative to the fold length 11. This divides the fold length 11 into two envelope assemblies 19 and 20.

To provide the various assemblies, the form is provided with a continuous top ply 21, a continuous bottom ply 22 and one or more discontinuous intermediate plies 23.

In accordance with the invention, the intermediate ply or plies 23 are completely discontinuous adjacent each line of potential folding 14–17 and are only partially discontinuous adjacent each line of weakness 18 defining a form length. More particularly, it will be noted that each intermediate ply in the portion bridging the line of weakness 18 is equipped with an integral attaching portion 24—see the upper central portion of FIG. 1. This attaching portion performs a number of functions. First, it enables the intermediate plies to be long enough so as to satisfactorily and reliably bridge the spacing between cutoff and downstream control elements in the collator. Second, it occurs at a portion of the fold length which is not folded so as to avoid any problem of tenting. Thirdly, it constitutes only a minor portion of the width of the intermediate ply or plies so as to provide minimal resistance to bursting.

The invention can be further appreciated from the method of manufacture set down below.

METHOD OF MANUFACTURE

In producing the inventive form on a conventional mailer collator, the bottom web 22 is previously provided with a control margin or margins along the longitudinal edges 25 and 26. In the illustration given, each edge is equipped with a control margin including line holes 27. Thereafter the bottom web 22 is equipped with transverse glue lines as at 28 and 29 adjacent each fold line 14–17, and further transverse glue lines as at 30 and 31 adjacent each line of weakness defining a form length. The bottom ply is also provided with longitudinally extending glue lines as at 32 and 33.

The intermediate ply or plies 23 are previously printed and, in the illustration given, equipped with line holes 34. Incident to cutoff, a chip is removed to provide the discontinuity 35. Thereafter, the intermediate ply or plies are brought into register with the bottom ply 22 and thereafter the top ply 21 which has been previously printed, equipped with line holes and further equipped with a longitudinal line of adhesive on its underside as at 36 is brought into contact with the intermediate and bottom plies.

OPERATION

After the fanfolded assemblies have been delivered to the customer's plant, they are normally processed through the computer printer where addressee and other pertinent information is imprinted thereon. Normally, the top and intermediate plies are constructed of carbonless paper or carbonized areas so as to develop the imprint from the computer printer although in some instances, carbon interleaves may be employed.

After the continuous series of envelope assemblies has been suitably imprinted, the control margins are trimmed and the various envelopes 19–20 are burst apart along the lines of potential folding 14–17 and along the lines of weakness between form lengths as at 18. Thus, it will be seen that the lines of potential folding 14–17 perform a dual purpose in not only developing the positions of folding but also perform the same bursting function as the intermediate lines of weakness 18.

The invention can be advantageously employed where the intermediate plies do not have line holes as at 34. For example, the intermediate plies need not extend all the way to the edge 25 but can have an edge slightly inward of the line holes 27.

It is also possible within the scope of the invention to provide the attaching portion or means 24 along both edges of the intermediate ply or plies 23 or, for that matter, in a position more central.

I claim:

1. A business form having a plurality of fold lengths for mailer usage comprising top and bottom piles having longitudinally extending edges, at least one edge being equipped with a control margin, at least one intermediate ply between said top and bottom piles and including a series of at least two form lengths constituting a fold length, said top and bottom piles having transverse lines of weakness every form length and a line of potential folding at each fold length, said intermediate ply terminating a spaced distance short of said lines of potential folding and further being partially discontinuous about each line of weakness, and adhesive means joining said plies together.

2. The form of claim 1 in which said intermediate ply has a pair of laterally extending edges, said intermediate ply having a minor longitudinal attaching portion continuous between said intermediate ply edges to provide the partial discontinuity.

3. The form of claim 2 in which said minor longitudinal portion is adjacent one of said intermediate ply edges.

4. The form of claim 2 in which one of said intermediate ply laterally extending edges is generally coincident with one of said top and bottom ply longitudinally extending edges.

5. A business form having a plurality of fold length suitable for mailer usage comprising top and bottom plies having longitudinally extending edges, at least one edge being equipped with a control margin, at least one intermediate ply between said top and bottom plies and including a series of at least two form lengths constituting a fold length, said top and bottom plies having transverse lines of weakness every form length and a line of potential folding at each fold length, said form length not being greater than about $4\frac{1}{4}''$.

said intermediate ply terminating a spaced distance short of said lines of potential folding and further being partially discontinuous about each line of weakness, and adhesive means joining said plies together.

* * * * *